US007455766B1

(12) United States Patent
Lewis

(10) Patent No.: US 7,455,766 B1
(45) **Date of Patent: *Nov. 25, 2008**

(54) SYSTEM FOR FILTERING STORMWATER-CARRIED DEBRIS FLOWING THROUGH A GUTTER INLET INTO A CATCH BASIN

(75) Inventor: Randy Lewis, Charlotte, NC (US)

(73) Assignee: Erosion Control Products, Inc., Monroe, NC (US)

( * ) Notice: Subject to any disclaimer, the term of this patent is extended or adjusted under 35 U.S.C. 154(b) by 81 days.

This patent is subject to a terminal disclaimer.

(21) Appl. No.: 11/592,445

(22) Filed: Nov. 3, 2006

Related U.S. Application Data

(63) Continuation-in-part of application No. 11/264,940, filed on Nov. 2, 2005, now Pat. No. 7,300,574.

(51) Int. Cl.
*E03F 5/14* (2006.01)

(52) U.S. Cl. ..... 210/163; 210/170.03; 210/473; 404/4

(58) Field of Classification Search ..... 210/163, 210/164, 170.03, 473, 474; 404/4, 5
See application file for complete search history.

(56) References Cited

U.S. PATENT DOCUMENTS

| | | | | |
|---|---|---|---|---|
| 248,559 | A | 10/1881 | Jackson | |
| 4,268,390 | A | 5/1981 | Cunningham | 210/232 |
| 5,403,474 | A | 4/1995 | Emery | 210/163 |
| 5,632,888 | A | 5/1997 | Chinn et al. | 210/163 |
| 5,954,952 | A | 9/1999 | Strawser, Sr. | 210/164 |
| 6,214,216 | B1 | 4/2001 | Isaacson | 210/162 |
| 6,274,036 | B1 | 8/2001 | Ellis | 210/164 |
| 6,709,579 | B1 | 3/2004 | Singleton et al. | 210/163 |
| 6,811,708 | B2 * | 11/2004 | Shaw et al. | 210/163 |
| 6,824,677 | B2 | 11/2004 | Martinez | 210/97 |
| 6,974,540 | B1 | 12/2005 | Fleischmann | 210/163 |
| 7,005,060 | B2 | 2/2006 | Pitt et al. | 210/163 |
| 7,040,838 | B2 | 5/2006 | Allard et al. | 405/36 |
| 7,052,207 | B1 | 5/2006 | Wimberger | 405/40 |
| 7,179,371 | B1 | 2/2007 | Bistline | 210/163 |
| 2004/0016692 | A1 | 1/2004 | Sasaki et al. | 210/473 |
| 2004/0112811 | A1 | 6/2004 | Lindemulder | 210/163 |
| 2005/0199537 | A1 | 9/2005 | Kluge | 210/164 |
| 2006/0049085 | A1 | 3/2006 | Parker | 210/163 |
| 2007/0090033 | A1 | 4/2007 | Kelley et al. | 210/163 |

OTHER PUBLICATIONS

*Gutterbuddy*, Curb Inlet Drain Filters, ACF Environmental, specification sheet, ACF, Richmond, VA, 2 pages, no date.

(Continued)

*Primary Examiner*—Christopher Upton
(74) *Attorney, Agent, or Firm*—K & L Gates LLP

(57) ABSTRACT

A system for filtering debris carried by stormwater flowing through a gutter inlet into a catch basin utilizes a filter device configured to conform to and to substantially cover the gutter inlet and a retainer device for maintaining the filter device in place covering the gutter inlet. The retainer device is attached to the filter device and configured to extend through the gutter inlet to hang gravitationally downwardly into the catch basin. The retainer device is weighted to gravitationally pull and hold the filter device securely against the gutter inlet against dislodgement under the forces of flowing stormwater.

23 Claims, 4 Drawing Sheets

OTHER PUBLICATIONS

*Gutterbuddy, The BMP Store.com—Filter Inlet Protection*. Gutterbuddy, www.thebmpstore.com. Oct. 9, 2005, 3 pages.

Advertisement, *UltraGutterGuard®, BMP—Best Management Practice*, 1 page, no date.

Advertisement, *Ultra CurbGuard®, Insert-Style*, X-Tex™, 1 page, no date.

Advertisement, *Ultra DrainGuard®, Curb-Insert Style*, BMP—Best Management Practice, 1 page, no date.

SS-300 Silt-Saver Curb Inlet Filter drawing, Silt-Saver, Inc., Drawing #SS-300, Apr. 19, 2004, with attached specification sheet, 2 pages.

Advertisement, *Storm Water Filter & Safety Guard*, Silt-Saver, Inc., Conyers, GA, 1 page, no date.

*Dandy Curb™, Dandy Products: True Dam*, www.dandyproducts.com, Oct. 11, 2005, 2 pages.

Advertisement, Dandy Products, The Stormwater Management Authority, 1 page, no date.

Advertisement, *Who's guarding your inlets?*, The BMP Store.com, 1 page, no date.

* cited by examiner

SYSTEM FOR FILTERING STORMWATER-CARRIED DEBRIS FLOWING THROUGH A GUTTER INLET INTO A CATCH BASIN

BACKGROUND

The present application is a continuation-in-part of co-pending U.S. application Ser. No. 11/264,940, filed Nov. 2, 2005 and entitled "SYSTEM FOR FILTERING STORMWATER-CARRIED DEBRIS FLOWING THROUGH A GUTTER INLET INTO A CATCH BASIN," which is incorporated herein by reference in its entirety.

The present invention relates generally to stormwater drainage systems and, more particularly, to a novel system for filtering sediment and debris from stormwater flowing through a gutter inlet and gravitationally therefrom into a catch basin therebelow.

Stormwater drainage systems are commonplace and, indeed, are mandated for virtually all new building construction subject to the regulations of municipal and county building codes throughout the United States. Essentially, a stormwater drainage system comprises a series of catch basins strategically located according to the topography of a given region under development, with the catch basins emptying into drainage pipes leading to existing streams, creeks, lakes or rivers. In the construction of streets in new building developments, catch basins are required to be constructed below grade alongside the streets to receive stormwater runoff via basin inlets formed in roadside storm gutters.

The growing awareness of environmental conservation issues over recent decades has raised awareness of the significant erosion of bare land which can occur during the course of building construction as a result of stormwater drainage over the bare land. Eroded soil in the form of silt and sediment along with other debris can be carried in significant quantities by stormwater runoff along street gutters and into stormwater drainage systems, sometimes to such a significant extent to clog stormwater catch basins and drainage pipes, and in any event taxing the capacities of and polluting existing streams, creeks, lakes and rivers. As a result, most building codes regulated by municipalities and county building offices have implemented regulations requiring various steps to be taken to prevent or at least mitigate stormwater erosion of soil during building construction, including steps such as the erection of silt fences.

Despite these measures, stormwater runoff still carries a not insignificant amount of silt, sediment and other debris into storm drainage systems. As a result, some form of filtering device is now generally required to be installed in gutter inlets into stormwater catch basins during the course of construction projects to attempt to prevent such debris from entering stormwater drainage systems. Various such filtration devices have been proposed, including for example devices described in U.S. Pat. Nos. 5,403,474; 5,632,888; 5,954,952; 6,709,579; and 6,824,677 and published U.S. Patent Application No. 2004/0112811. While many of these devices may be generally effective for their intended purpose and function, the devices which have achieved commercial use tend to be disadvantageously heavy, bulky and unwieldy. Furthermore, in order to brace against the force generated by stormwater runoff, which can be significant during periods of heavy rain, the filtering medium commonly used in these devices tends to be heavy to assist in holding the devices in place. In turn, the filtration medium also tends to impede the free flow of the stormwater runoff which can result in flooding of the adjacent gutters and streets as water is restricted from entering the catch basins.

SUMMARY OF THE INVENTION

It is accordingly an object of the present invention to provide a system for filtering debris carried by stormwater flowing through a gutter inlet into an associated catch basin which addresses the disadvantages of the known prior art. A more particular object of the present invention is to provide a stormwater debris-filtering system which enables the use of low density, lightweight filtration media. Another object of the present invention is to provide a stormwater debris-filtering system which is relatively easy to install at a gutter inlet and will resist the forces of water flowing through the filtering media so as to remain securely in place. Still another object of the present invention is to provide a stormwater debris-filtering system which permits excess stormwater runoff to enter the gutter inlet as the level of water runoff rises above the height of the filtering system.

Briefly summarized, the stormwater debris-filtering system of the present invention utilizes a filter device configured in conformity to the gutter inlet to substantially cover the gutter inlet exteriorly of the catch basin without passing through the gutter inlet into the catch basin. The filter device is comprised of filtration media selected to prevent passage through the filter device of soil, silt, leaves, sticks and other stormwater-carried debris, while permitting substantially free passage through the filter device of stormwater. A retainer device is provided for maintaining the filter device in covering relation to the gutter inlet. More specifically, the retainer device is attached to the filter device and configured to extend through the gutter inlet and to depend gravitationally downwardly therefrom within the catch basin. The retainer device is weighted sufficiently to gravitationally pull the filter device securely against the gutter inlet to resist dislodgement under the forces of stormwater flowing therethrough.

It is contemplated that any of various types of filtration media may be utilized in the present invention, and selected according to the particular filtration needs of a given application or environment. It is contemplated that, in various embodiments, it will be desirable for the filtration media to be of a lightweight material having a lesser density than water, such as a filtration media made of a polymeric material, e.g., an expanded polymeric bead material such as expanded polystyrene.

Preferably, the filter device comprises a flexible tubular fabric sock, e.g., of an elongate cylindrical shape, for containing the filtration media. The tubular fabric sock together with the filtration media is preferably deformable into conformity to the gutter inlet. In this manner, the filter device is enabled to conform to the gutter inlet so as to prevent debris-laden stormwater from entering the gutter inlet without flowing through the filter device.

The retainer device may be of various shapes and forms. In one contemplated embodiment, the retainer device comprises a sleeve portion configured to receive the filter device extended longitudinally therethrough and a sack portion for containing a weighting material, such as sand, gravel or soil.

In one contemplated embodiment, the stormwater debris-filtering system of the present invention may further comprise an overflow device for positioning at least a portion of the filter device a distance from the upper exterior periphery of the gutter inlet. The overflow device is arranged adjacent the filter device to facilitate passage of excess stormwater over the filter device and through the gutter inlet. In accordance with one preferred aspect, the overflow device comprises a cushion filled with the filtration media. In accordance with another preferred aspect, the overflow device comprises a sleeve portion configured to receive the filter device extended longitudinally therethrough.

Other various embodiments of the stormwater debris-filtering system of the present invention will be recognizable and understood to persons knowledgeable and skilled in the relevant industry and are intended to be within the scope of the present invention. Without limiting the scope and substance of the invention, further details, features and advantages of the invention will be described and understood from a description of a preferred embodiment as presently contemplated, set forth in the following specification with reference to, the accompanying drawings.

DETAILED DESCRIPTION

Figure 1:
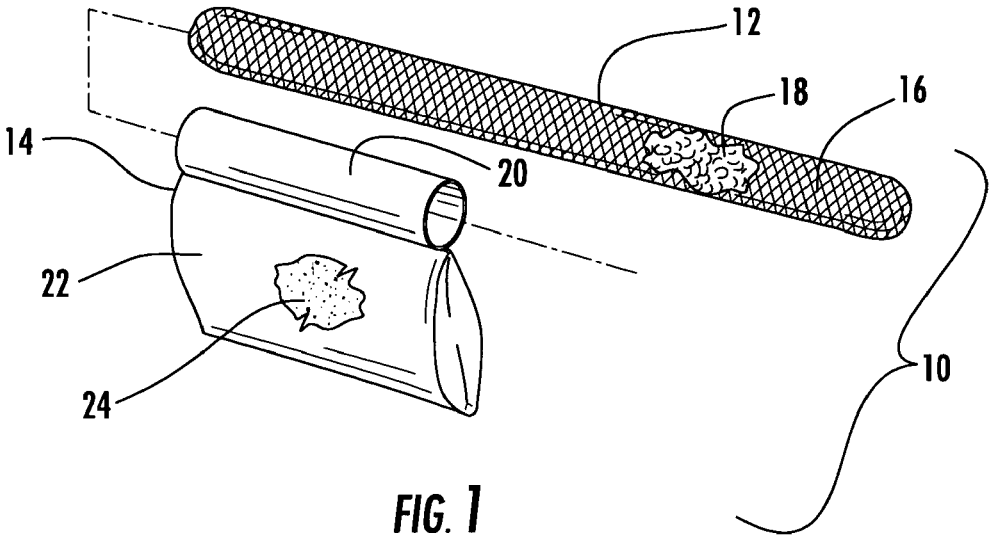
FIG. 1 is a perspective view of the stormwater debris-filtering system of the present invention, with the filter device exploded from the retainer device.

Referring now to the accompanying drawings and initially to FIG. 1, the system of the present invention for filtering stormwater-carried debris is indicated overall in FIG. 1 by reference numeral 10 and basically comprises a conformable filter device 12 attachable to a weighted retainer device 14.

The filter device 12 may be of any of various constructions and configurations so as to be conformable to the shape and size of a gutter inlet of a conventional form of stormwater catch basin. In a presently contemplated embodiment, the filter device 12 may be of an elongate cylindrical shape and sufficiently flexible and deformable to generally mold into conformity to the gutter inlet. In the embodiment as illustrated in FIG. 1, the filter device 12 comprises an elongate flexible tubular fabric sock 16 of an open mesh geotextile fabric structure so as to readily permit stormwater to flow therethrough. A quantity of filter media 18 is contained within and fully occupies the filter sock 16. The filter media 18 may be of any of various types, selected to permit substantially free flow of stormwater through the filter media while separating from the stormwater any debris, such as soil, silt, leaves, sticks, and the like carried by the stormwater. While various filter media will provide satisfactory results, one type of filter media which is believed to be quite advantageous is an expanded polymeric bead material, such as expanded polystyrene beads, which offer the advantage of being light weight, while performing efficient filtration of all types of debris with minimal inhibition of water flow through the media.

The retainer device 14 may be of any suitable construction adapted to attach to the filter device and to have sufficient weight to hang gravitationally downwardly from the filter device through a gutter inlet into a catch basin, as described more fully hereinafter. In the embodiment illustrated, the retainer device 14 includes an attachment portion 20 in the form of an open-ended tubular mesh fabric sleeve sized to allow the filter device 12 to be snugly inserted longitudinally through the attachment portion 20. The illustrated embodiment of the retainer device 14 further includes a weighted portion 22 fixed to the attachment portion 20 and configured to pass through a gutter inlet and to depend gravitationally downwardly from the gutter inlet into an associated catch basin. The weighted portion 22 in the illustrated embodiment is preferably in the form of a sack fabricated of a high strength flexible fabric material, such as a tightly woven geotextile material, which can contain a quantity of a weighting material such as sand, gravel or a similar material representatively indicated at 24.

Figure 2:
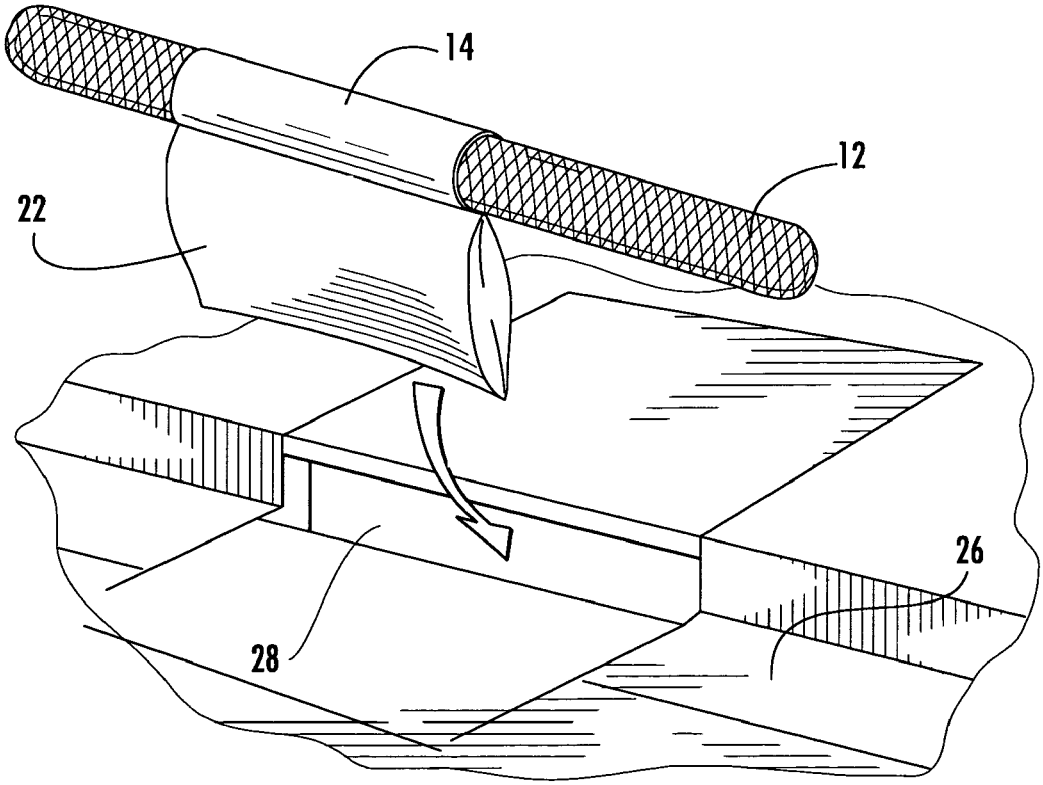
FIG. 2 is a perspective view depicting the stormwater debris-filtering system of FIG. 1 in assembled condition and in the process of being installed into operational disposition in a representative gutter inlet and associated catch basin.
Figure 3:
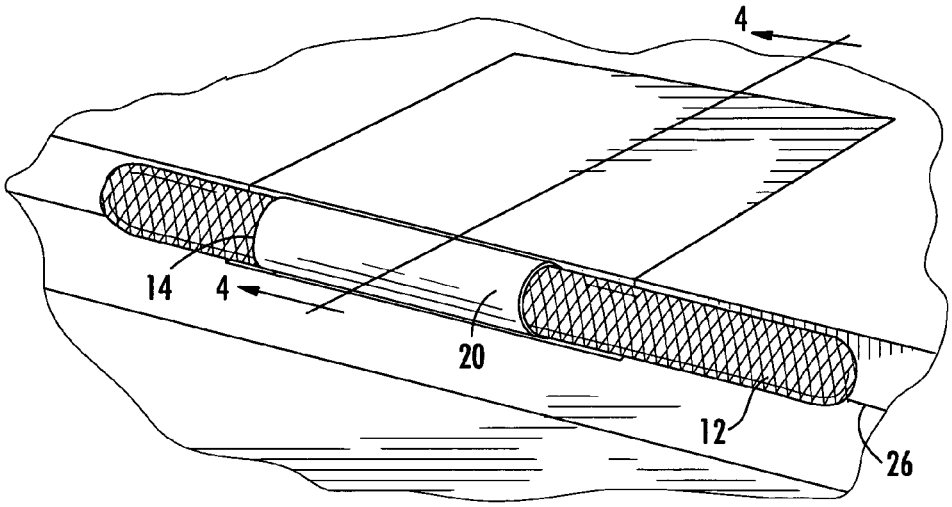
FIG. 3 is a perspective view similar to FIG. 2, depicting the stormwater debris-filtering system of the present invention as fully installed in the gutter inlet and associated catch basin.
Figure 4:
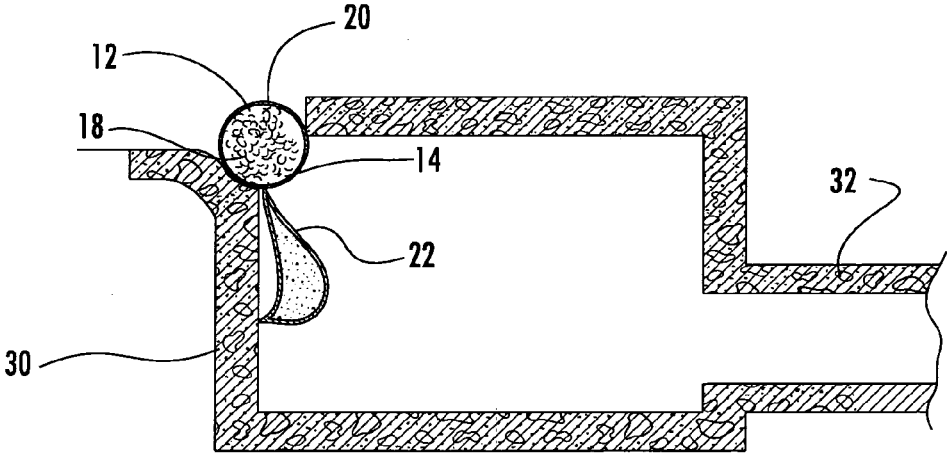
FIG. 4 is a vertical cross-sectional view of the installed stormwater debris-filtering system of FIG. 3, taken along line 4-4 thereof vertically through the gutter inlet, the filtering system, and the catch basin.

The installation and use of the stormwater debris-filtering system 10 of the present invention may best be understood with reference to FIGS. 2-4 of the drawings. In each drawing, a representative form of a conventional stormwater drainage system is schematically depicted wherein a roadside stormwater drainage gutter 26 is formed with a gutter inlet 28 to drain stormwater runoff gravitationally into a catch basin 30 situated immediately beneath the inlet 28 and communicating with a stormwater drainage pipe 32 to transport the runoff stormwater into a natural water collection area, such as a nearby creek, stream, pond, river, etc. The filtering system 10 is assembled with at least one retainer device 14 attached to the filter device 12 and with a sufficient quantity of the weighting material 24 contained within the weighted portion 22 of the retainer device 14. Multiple retainer devices 14 may be utilized in the case of a gutter inlet of significant length requiring a correspondingly long filter device 12. The weighted sack portion 22 of the retainer device 14 is then inserted through the gutter inlet 28 so as to hang therefrom gravitationally downwardly into the catch basin 30. Before releasing the retainer device 14, the elongate filter device 12 is positioned to extend fully along the entire length of the gutter inlet 28. The retainer device 14 is then released, whereby its weight pulls the filter device 12 gravitationally against the gutter inlet. The flexibility of the outer fabric sock 16 together with the deformability of the filter media 18 within the filter sock 16 enables the filter device 12 to mold conformingly to the shape and configuration of the opening of the gutter inlet 28, thereby essentially closing the inlet 28 against entry of stormwater runoff except by flow through the filter sock 16 and filter media 18.

In another contemplated embodiment of the present invention, shown in FIGS. 5-8, the stormwater debris-filtering system may include an overflow device 34 adapted to be attached adjacent to the filter device 12. With respect to some particularly heavy storms, the volume of stormwater may be sufficiently high so as to exceed the height of the filter device 12. In such instances, the overflow device 34 is positioned with respect to the gutter inlet to separate at least a portion of the filter device 12 from the upper periphery of the gutter inlet 28, thus permitting excess stormwater runoff arising from particularly high stormwater volume to pass over the filter device 12 and through the gutter inlet 28 to the catch basin 30.

Figure 5:
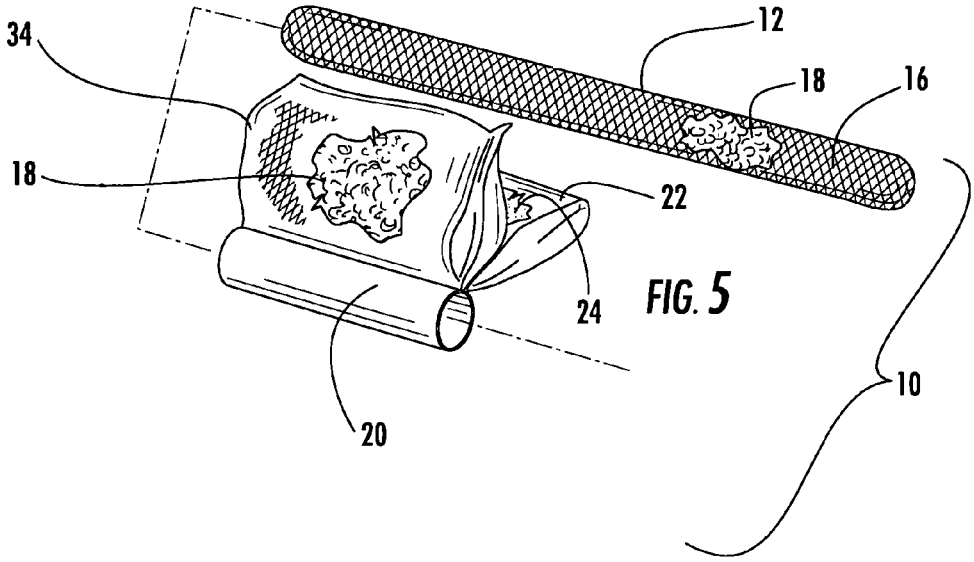
FIG. 5 is a perspective view of the stormwater debris-filtering system of FIG. 1 with an overflow device positioning the filter device a distance from the upper periphery of the gutter inlet.

The overflow device 34 may be of any various size and configuration so as to sufficiently separate at least a portion of the filter device 12 from the upper periphery of the gutter inlet 28 by some selected distance. In accordance with one embodiment, shown in FIG. 5, the overflow device 34 is a pillow-like cushion composed of a geotextile fabric structure that permits stormwater to flow therethrough. The fabric structure of the overflow device 34 preferably has a durable quality to withstand abrasion and repeated use during heavy storm activity or other instances of high stormwater volume. Moreover, the fabric structure of the overflow device 34 may be sufficiently flexible and deformable so as to generally conform with various shapes and sizes of gutter inlets, and particularly at the upper periphery thereof. Advantageously, as shown in FIG. 5, the overflow device 34 may be filled with the same or similar filter media 18 as is contained within the filter sock 16 so as to provide additional filtration for excess stormwater runoff exceeding the height of the filter device 12 that enters into contact with the overflow device 34.

The size of the overflow device 34 may be selected to reflect the size of the gutter inlet 28 and the amount of excess stormwater runoff that might be expected at or near the drainage gutter 26. In some areas where a stormwater debris-filtering system may be necessary or helpful, the size of the overflow device 34 may be relatively small in relation to the size of the gutter inlet 28. In such instances, a small gap between the filter device 12 and the upper periphery of the gutter inlet 28 may be sufficient to provide the necessary relief in the event that some excess stormwater accumulates. However, in some areas where the amount of excess stormwater volume is expected to be particularly heavy, features of the overflow device 34, such as the depth, may be adjusted so as to permit a greater volume of excess stormwater to pass unimpeded over the filter device 12, through the gutter inlet 28, and into the catch basin 30. For instance, the depth of the overflow device 34 may be increased so as to position the filter device 12 at a greater distance from the inlet 28, thus facilitating the passage of a greater volume of excess stormwater runoff over the filter device 12, through the inlet 28, and into the catch basin 30. Additionally, a plurality of overflow devices may be used in association with a filtering system 10.

The overflow device 34 may be affixed to an attachment portion 20 in the form of an open-ended tubular mesh fabric sleeve sized to allow the filter device 12 to be snugly inserted longitudinally through the attachment portion. In accordance with a preferred construction of this embodiment, shown in FIG. 5, the overflow device 34 may be attached to the attachment portion 20 of the retainer device 14 such that each of the overflow device 34 and the weighted sack portion 22 of the retainer device 14 are attached to the attachment portion 20 at the same location so as to facilitate joint attachment of each of the retainer device 14 and the overflow device 34 to the filter device 12. It is also within the scope of the present invention that the overflow device 34 may be attached to the filter device 12 by a separate attachment portion or may be attached to the filter device 12 directly.

Figure 6:
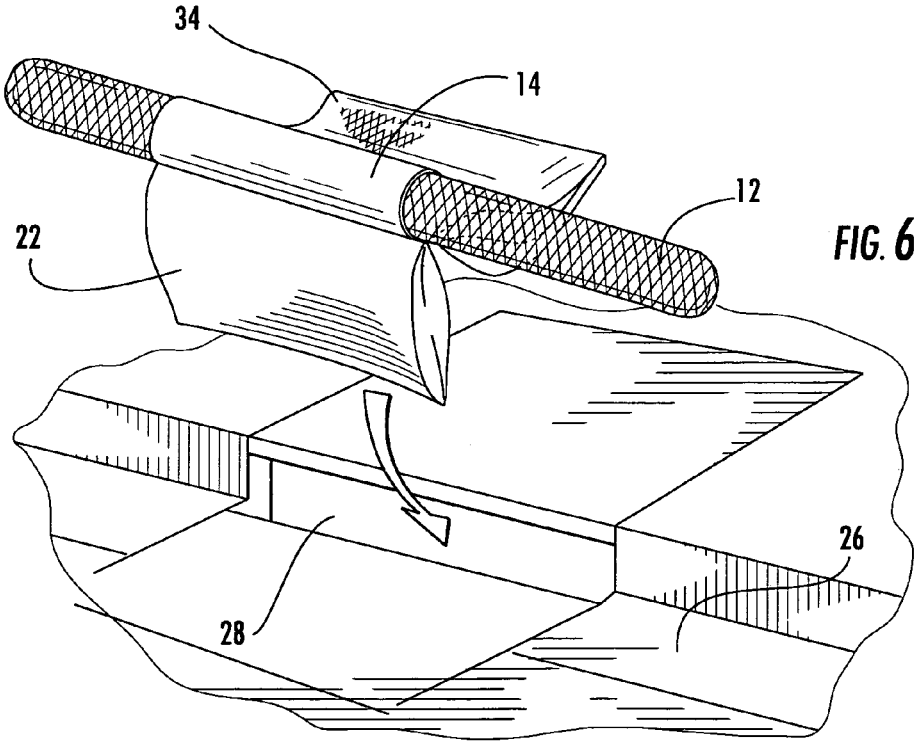
FIG. 6 is a perspective view depicting the stormwater debris-filtering system of FIG. 5 in assembled condition and in the process of being installed into operational disposition in a representative gutter inlet and associated catch basin.
Figure 7:
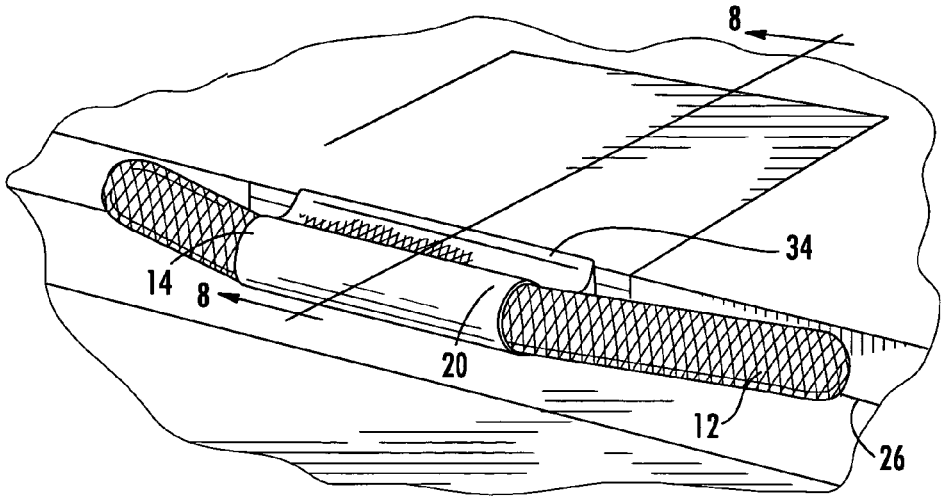
FIG. 7 is a perspective view of the stormwater debris-filtering system of FIG. 5 as fully installed in the gutter inlet and associated catch basin.
Figure 8:
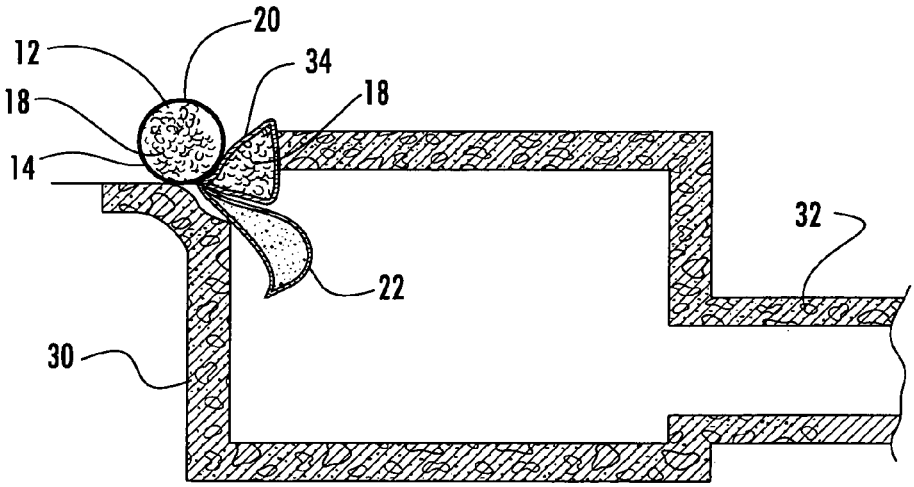
FIG. 8 is a vertical cross-sectional view of the installed stormwater debris-filtering system of FIG. 7, taken along line 8-8 thereof vertically through the gutter inlet, the filtering system, the overflow device, and the catch basin.

With reference to FIGS. 6-8, installation and use of the stormwater debris-filtering system 10 with an overflow device 34 may thus be understood. The filtering system 10 is assembled with at least one retainer device 14 attached to the filter device 12 and with a sufficient quantity of the weighting material 24 contained within the weighted portion 22 of the retainer device 14. Multiple retainer devices 14 may be utilized in the case of a gutter inlet of significant length requiring a correspondingly long filter device 12. The weighted sack portion 22 of the retainer device 14 is then inserted through the gutter inlet 28 so as to hang therefrom gravitationally downwardly into the catch basin 30. Before releasing the retainer device 14, the elongate filter device 12 is positioned to extend fully along the entire length of the gutter inlet 28. The overflow device 34 is positioned to extend away from the filter device 12 such that the overflow device 34 is nestled between the filter device 12 and the gutter inlet 28 and rests against the upper exterior periphery of the gutter inlet 28. The retainer device 14 is then released, whereby its weight pulls the filter device 12 gravitationally against the gutter inlet 28. The flexibility of the outer fabric sock 16 together with the deformability of the filter media 18 within the filter sock 16 enables the filter device 12 to mold conformingly to the shape and configuration of the opening of the gutter inlet 28. The overflow device 34 pushes at least a portion of the upwardly facing extent of the filter device 12 away from the length of the gutter inlet 28 so as to create a gap between the upwardly facing extent of the filter device 12 and the upper extent of the inlet 28, while maintaining the downwardly facing extent of the filter device 12 in contact with the gutter 26. The filtering system 10 thereby substantially closes the gutter inlet 28 against entry of stormwater runoff except by flow through the filter sock 16, the overflow device 34, and filter media 18 contained in each of the filter sock 16 and overflow device 34, and by entry of excess stormwater through the gap between the filter device 12 and the upper periphery of the gutter inlet 28 and into the catch basin 30.

Advantageously, the filtering system of the present invention enables substantially greater flexibility in the selection of varying types of filtering media without concern for the media having sufficient mass and weight to withstand undesired movement under the force of flowing stormwater runoff and, in turn, the filter media may be selected according to the criteria of optimizing the balance between the promotion of substantially free water flow through the device and filtration efficiency in removing silt and other debris. Thus, the present invention enables the use of lightweight, low density polymeric filter material which has not been possible with known filtration devices. In turn, the filtering system of the present invention is easier to handle and to install than known devices while still providing improved results.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A system for filtering debris carried by stormwater flowing through a gutter inlet and gravitationally therefrom into a catch basin therebelow, the filtering system comprising:

a filter device configured in conformity to the gutter inlet to substantially cover the gutter inlet exteriorly of the catch basin without passing through the gutter inlet into the catch basin;

the filter device being comprised of filtration media selected to prevent passage through the filter device of soil, silt, leaves, sticks, and other stormwater-carried debris, while permitting substantially free passage through the filter device of stormwater; and a retainer device for maintaining the filter device in substantially covering relation to the gutter inlet;

the retainer device configured to extend from the filter device through the gutter inlet and to depend gravitationally downwardly therefrom within the catch basin;

the retainer device being weighted sufficiently to gravitationally pull the filter device securely against the gutter inlet to resist dislodgement under the forces of stormwater flowing therethrough.

2. A system for filtering debris carried by stormwater according to claim 1, wherein the filtration media is of a lesser density than the water.

3. A system for filtering debris carried by stormwater according to claim 2, wherein the filtration media is a polymeric material.

4. A system for filtering debris carried by stormwater according to claim 3, wherein the filtration media comprises expanded polymeric beads.

5. A system for filtering debris carried by stormwater according to claim 1, wherein the filter device comprises a flexible tubular fabric sock containing the filtration media, the filter device being deformable into conformity to the gutter inlet.

6. A system for filtering debris carried by stormwater according to claim 1, wherein the retainer device comprises a sleeve portion configured to receive the filter device extended longitudinally therethrough and a sack portion for containing a weighting material.

7. A system for filtering debris carried by stormwater according to claim 6, wherein the weighting material is sand.

8. A system for filtering debris carried by stormwater according to claim 6, wherein the weighting material is gravel.

9. A system for filtering debris carried by stormwater according to claim 1, wherein the filtering system comprises an overflow device for positioning at least a portion of the filter device a distance from an upper exterior periphery of the gutter inlet, the overflow device being arranged adjacent the filter device to facilitate passage of excess stormwater over the filter device and through the gutter inlet.

10. A system for filtering debris carried by stormwater according to claim 9, wherein the overflow device comprises a cushion filled with the filtration media.

11. A system for filtering debris carried by stormwater according to claim 10, wherein the overflow device comprises a sleeve portion configured to receive the filter device extended longitudinally therethrough.

12. A system for filtering debris carried by stormwater flowing through a gutter inlet and gravitationally therefrom into a catch basin therebelow, the filtering system comprising:

a filter device configured in conformity to the gutter inlet to substantially cover the gutter inlet exteriorly of the catch basin without passing through the gutter inlet into the catch basin;

the filter device being comprised of filtration media selected to prevent passage through the filter device of soil, silt, leaves, sticks, and other stormwater-carried debris, while permitting substantially free passage through the filter device of stormwater;

a retainer device for maintaining the filter device in substantially covering relation to the gutter inlet;

the retainer device configured to extend from the filter device through the gutter inlet and to depend gravitationally downwardly therefrom within the catch basin;

the retainer device being weighted sufficiently to gravitationally pull the filter device securely against the gutter inlet to resist dislodgement under the forces of stormwater flowing therethrough; and an overflow device for positioning at least a portion of the filter device a distance from an upper exterior periphery of the gutter inlet;

the overflow device being arranged adjacent the filter device to facilitate passage of excess stormwater over the filter device and through the gutter inlet.

13. A system for filtering debris carried by stormwater according to claim 12, wherein the filtration media is of a lesser density than the water.

14. A system for filtering debris carried by stormwater according to claim 13, wherein the filtration media is a polymeric material.

15. A system for filtering debris carried by stormwater according to claim 14, wherein the filtration media comprises expanded polymeric beads.

16. A system for filtering debris carried by stormwater according to claim 12, wherein the filter device comprises a flexible tubular fabric sock containing the filtration media, the filter device being deformable into conformity to the gutter inlet.

17. A system for filtering debris carried by stormwater according to claim 12, wherein the retainer device comprises a sleeve portion configured to receive the filter device extended longitudinally therethrough and a sack portion for containing a weighting material.

18. A system for filtering debris carried by stormwater according to claim 17, wherein the weighting material is sand.

19. A system for filtering debris carried by stormwater according to claim 17, wherein the weighting material is gravel.

20. A system for filtering debris carried by stormwater according to claim 12, wherein the overflow device comprises a substantially enclosed cushion filled with the filtration media.

21. A system for filtering debris carried by stormwater according to claim 20, wherein the overflow device comprises a sleeve portion configured to receive the filter device extended longitudinally therethrough.

22. A system for filtering debris carried by stormwater flowing through a gutter inlet and gravitationally therefrom into a catch basin therebelow, the filtering system comprising:

a filter device configured in conformity to the gutter inlet to substantially cover the gutter inlet exteriorly of the catch basin without passing through the gutter inlet into the catch basin, the filter device comprising a flexible tubular fabric sock containing filtration media selected to prevent passage through the filter device of soil, silt, leaves, sticks, and other stormwater-carried debris, while permitting substantially free passage through the filter device of stormwater;

a retainer device configured to extend from the filter device through the gutter inlet and to depend gravitationally downwardly therefrom within the catch basin so as to maintain the filter device in substantially covering relation to the gutter inlet, the retainer device being weighted sufficiently to gravitationally pull the filter device securely against the gutter inlet to resist dislodgement under the forces of stormwater flowing therethrough and comprising a sleeve portion configured to receive the filter device extended longitudinally therethrough and a sack portion for containing a weighting material, wherein the sack portion is attached to the sleeve portion; and an overflow device arranged adjacent the filter device for positioning at least a portion of the filter device a distance from an upper exterior periphery of the gutter inlet so as to facilitate passage of excess stormwater over the filter device and through the gutter inlet, the overflow device being attached to the sleeve portion of the retainer device at a location at least closely adjacent to the sack portion.

23. A system for filtering debris carried by stormwater according to claim 22, wherein the overflow device is attached to the sleeve portion of the retainer device at the same location as the sack portion.

* * * * *